US011628461B2

(12) United States Patent
Barbian

(10) Patent No.: US 11,628,461 B2
(45) Date of Patent: Apr. 18, 2023

(54) SPRINKLER PROTECTION DEVICE

(71) Applicant: Marcos Omar Barbian, Fort Myers, FL (US)

(72) Inventor: Marcos Omar Barbian, Fort Myers, FL (US)

( * ) Notice: Subject to any disclaimer, the term of this patent is extended or adjusted under 35 U.S.C. 154(b) by 268 days.

(21) Appl. No.: 17/143,733

(22) Filed: Jan. 7, 2021

(65) Prior Publication Data

US 2022/0212220 A1 Jul. 7, 2022

(51) Int. Cl.
*B05B 15/16* (2018.01)
*B05B 15/60* (2018.01)

(52) U.S. Cl.
CPC ..... *B05B 15/16* (2018.02); *B05B 15/60* (2018.02)

(58) Field of Classification Search
CPC ..... B05B 15/16; B05B 15/60; B05B 12/36; B05B 15/62; B05B 15/70; B05B 15/622
USPC ..... 239/288.5, 288.3, 288, 200, 201, 203
See application file for complete search history.

(56) References Cited

U.S. PATENT DOCUMENTS 1,717,709 A 6/1929 Johnson
2,757,045 A 7/1956 Mullet
3,904,120 A 9/1975 Sbicca
4,350,296 A * 9/1982 Kuhlman ..... A01G 25/06 D23/218
5,037,030 A 8/1991 Apodaca
5,213,262 A 5/1993 Violette
5,221,338 A 5/1993 Leite et al.
5,222,669 A * 6/1993 Lawson ..... B05B 15/74 239/203
5,772,118 A 6/1998 Fabiano
5,918,814 A 7/1999 Hough
5,931,385 A 8/1999 Miller
6,186,416 B1 2/2001 Jones
6,494,386 B1 * 12/2002 Banu ..... B05B 15/74 239/206
6,764,025 B1 7/2004 Espina
7,216,819 B2 5/2007 Bernards
7,946,507 B2 5/2011 Gauthier, III
8,517,286 B2 8/2013 Jung
8,550,375 B2 10/2013 Curtis
8,844,839 B1 9/2014 Touchet
8,936,206 B1 1/2015 Wright
2001/0032890 A1 * 10/2001 Stephens ..... B05B 15/16 239/200
2005/0023375 A1 * 2/2005 Tanczos ..... B05B 15/16 239/203

(Continued)

OTHER PUBLICATIONS

Unknown Author, Sprinkler Buddy,, Nov. 23, 2020 or earlier, https://www.lawntuneups.com/stewarts-recommended-products/sprinkler-buddy-pack-of-15-has-a-7-diameter-sprinkler-head-donuts-guards-for-lawn-sprinkler-heads-both-rotors-and-spray-head-sprinklers-remove-sprinkler-head-to-install-made-in-usa/.

*Primary Examiner* — Justin M Jonaitis
(74) *Attorney, Agent, or Firm* — George F. Wallace

(57) ABSTRACT

A sprinkler protection device can include a base and a top that removably engages the base. A base can include a cavity extending through upper and lower portions of the base, the lower portion can include at least one downwardly extending stake, and the upper portion can include at least one removable layer defining an upwardly facing opening exposing the cavity. A top can include a channel extending through upper and lower sections of the top, the lower section can include a downwardly facing opening that exposes the channel. With the top engaged with the base, the channel exposes at least a portion of the cavity.

9 Claims, 3 Drawing Sheets

(56) References Cited

U.S. PATENT DOCUMENTS

| | | | | |
|---|---|---|---|---|
| 2005/0284956 | A1 | 12/2005 | Mast | |
| 2007/0034714 | A1* | 2/2007 | Campbell | B05B 15/622 239/73 |
| 2009/0026286 | A1* | 1/2009 | Park | B05B 15/625 239/201 |
| 2009/0084869 | A1* | 4/2009 | Lin | B05B 15/16 239/201 |
| 2010/0127099 | A1 | 5/2010 | Memole | |
| 2012/0292404 | A1* | 11/2012 | Jung | B05B 15/16 239/288.5 |
| 2017/0095826 | A1* | 4/2017 | Schneider | B05B 15/16 |
| 2018/0056316 | A1* | 3/2018 | Biscardi | B05B 15/16 |

* cited by examiner

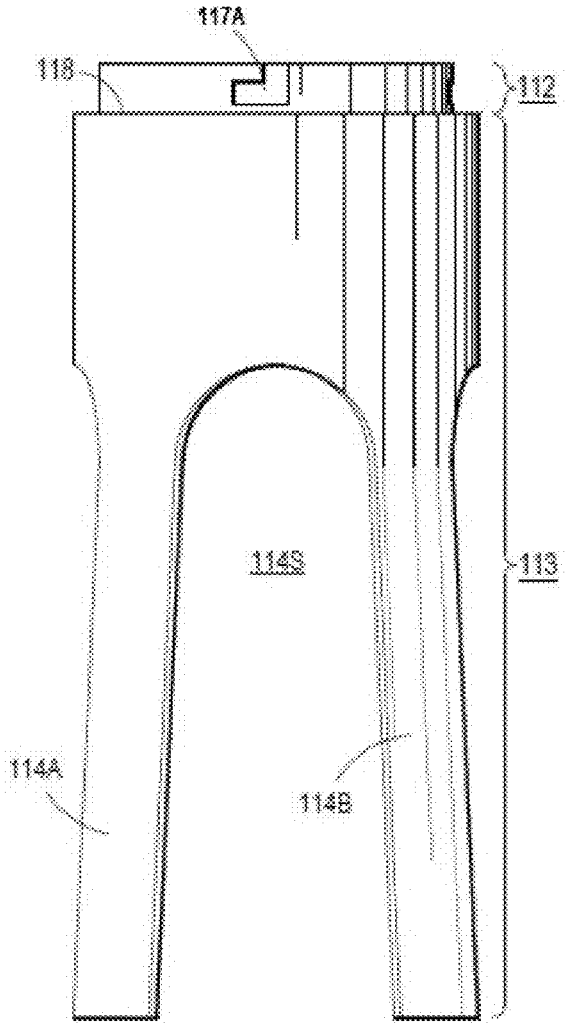
110 FIG. 3
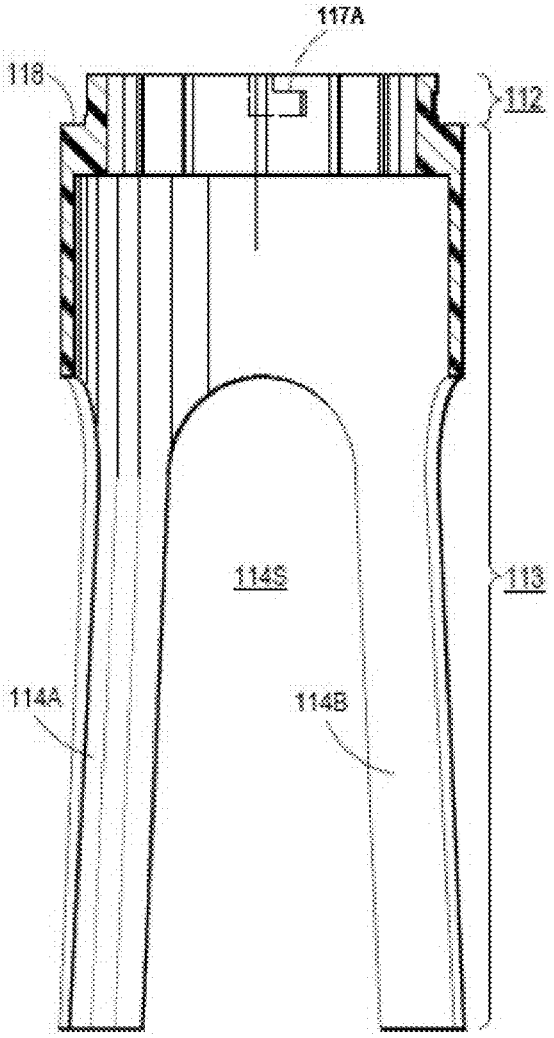
110 FIG. 4
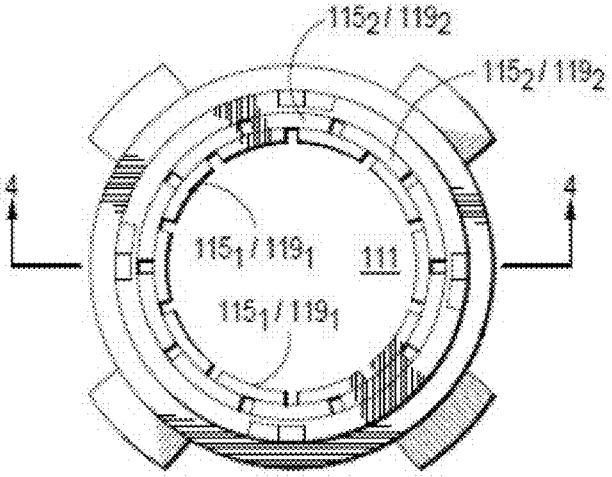
110 FIG. 5A
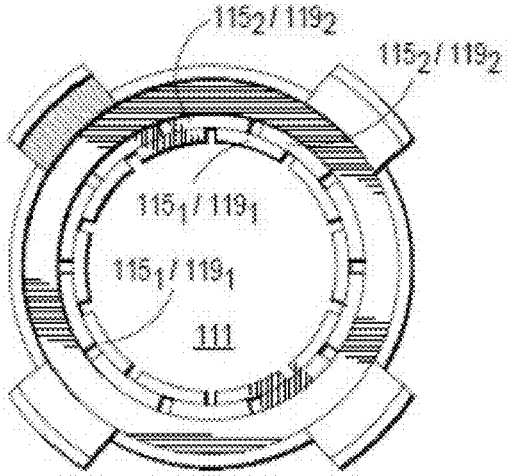
110 FIG. 5B

SPRINKLER PROTECTION DEVICE

FIELD OF THE INVENTION

The present invention relates to irrigation sprinklers, and more specifically, to sprinkler heads.

BACKGROUND OF THE INVENTION

Irrigation sprinklers provide regulated spraying of water to irrigate plant life. A particular type of sprinkler can be connected to an underground irrigation line carrying pressurized water, and can be exposed at a ground surface.

Such irrigation sprinklers are subject to damage from being exposed at a ground surface. From persons can stepping thereon to lawn care equipment rolling thereover, an irrigation sprinkler can be damaged from undesired forces. Further, such undesired forced can force irrigation sprinklers downwardly and into irrigation lines, which can damage such lines.

SUMMARY OF THE INVENTION

The present invention provides a sprinkler protection device and related methods of using the same.

An exemplary environment of the present invention can include a sprinkler connected to an underground irrigation line. However, the present invention can be adapted to multiple environments within the purview of one of ordinary skill in the art.

According to an exemplary embodiment of the present invention, a sprinkler protection device can include a base and a top.

A base can have a cavity that extends through upper and lower portions of the base. In exemplary aspects, the lower portion can include at least one downwardly extending stake, and the upper portion can include at least one removable layer defining an upwardly facing opening that exposes the cavity.

A top can have a channel that extends through upper and lower sections of the top. In exemplary aspects, the lower section can include a downwardly facing opening that exposes the channel, and the top can be configured to removably engage with the base.

In another exemplary aspect, with the top engaged with the base, the channel can expose at least a portion of the cavity.

In a further exemplary aspect, each at least one removable layer can decrease the size of the upwardly facing opening.

In an additional exemplary aspect, the upper portion can include at least one keyed structure, and the lower section can include at least one nub complimentarily shaped to engage the at least one keyed structure.

In still another exemplary aspect, the base can be tapered upwardly or downwardly.

In an exemplary aspect, the upper portion can include a plurality of removable layers, and each of the plurality of removable layers can respectively reduce the size of the upwardly facing opening.

In a further exemplary aspect, a stake can be tapered upwardly or downwardly.

In still a further exemplary aspect, the upper portion can includes an annular peripheral ledge that can abut the top.

In yet another exemplary aspect, one of the at least one removable layer can be provided as removable segments.

In still yet another exemplary aspect, the lower portion can include first and second downwardly extending stakes spaced apart to define a particular slot therebetween.

In yet a further exemplary aspect, the lower portion can further include third and fourth downwardly extending stakes spaced apart to define another slot therebetween and opposite the particular slot.

BRIEF DESCRIPTION OF THE DRAWINGS

FIG. 3 is a side view of an exemplary base.

FIG. 4 is a section view of an exemplary base.

FIG. 5A is a top view of an exemplary base.

FIG. 5B is a bottom view of an exemplary base.

DETAILED DESCRIPTION

It is an object of the present invention to provide a sprinkler protection device.

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of the present invention, which may be claimed with particularity in this or any future filed patent applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

According to the present invention, a sprinkler protection device can be formed from any one or more materials or combinations of materials, such as one or more of plastic, rubber, wood, metal, a crystalline material, or any other man-made or naturally occurring material, for example and not in limitation, insofar as functionally consistent with the present invention. Further, such a device can be manufactured in any one or more functionally compatible manners, such as through molding, cutting, machining, etc. For example, such a device can be formed at least in part from injection molding.

Figure 1:
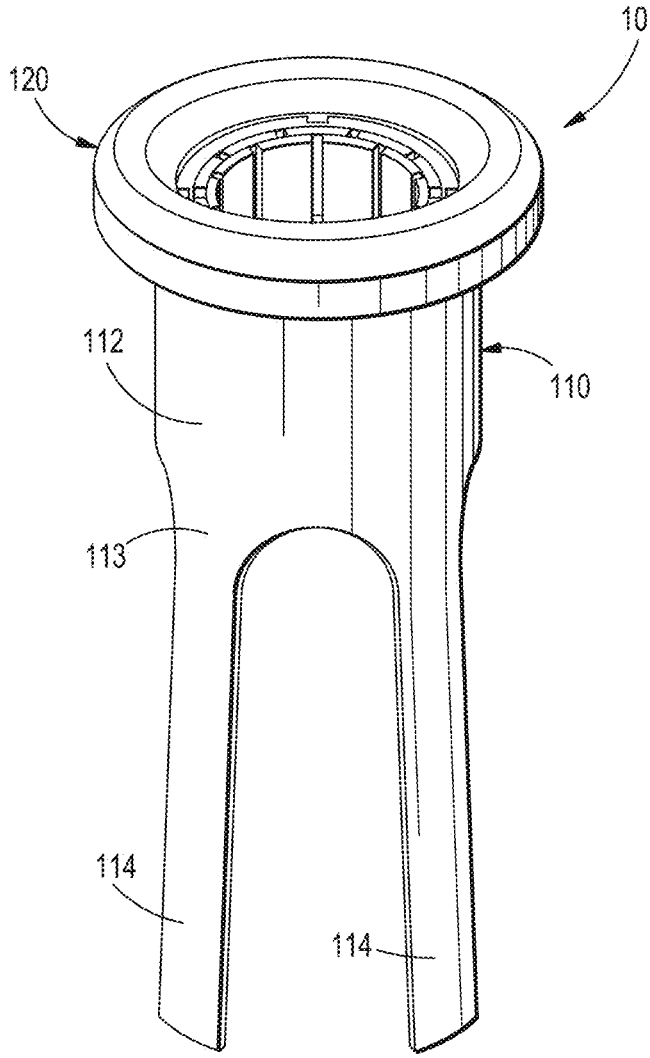
FIG. 1 is a perspective view of an exemplary sprinkler protection device.
Figure 2:
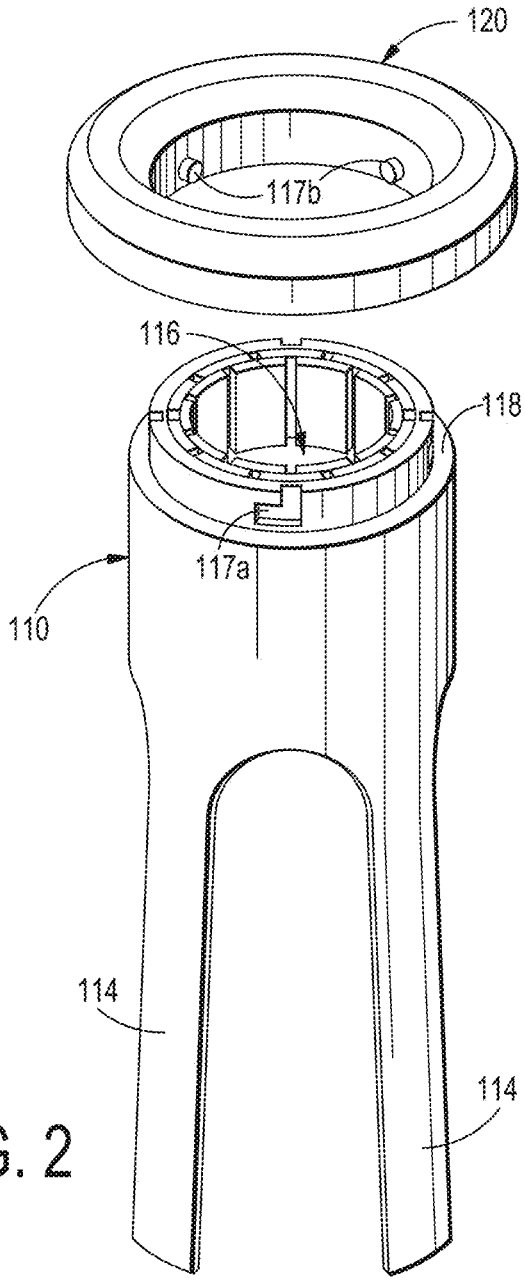
FIG. 2 is an exploded perspective view of an exemplary sprinkler protection device having a top and a base.

FIGS. 1 and 2 illustrate an exemplary embodiment of present invention, in which a sprinkler protection device 10 can include a base 110 and a top 120, with the base and top being complementarily configured to removably engage with each other (discussed infra).

In an exemplary aspect of present invention, base 110 can include a cavity 111 (illustratively shown in FIGS. 5A and 5B) that can extend through upper and lower portions 112, 113 of the base.

In another exemplary aspect, as illustrated in FIGS. 3 and 4, lower portion 113 can include at least one downwardly extending stake 114 (illustratively shown as 114A and 114B), which can assist in forcing device 10 into the ground and/or positionally maintaining the device around an irrigation sprinkler (not shown) to be protected. For example and not in limitation, lower portion 113 can include four stakes 114, which can optionally be equally spaced apart. In a further exemplary aspect, as illustrated in FIGS. 3 and 4, where lower portion 113 includes a plurality of stakes, first and second stakes 114A, 114B can be spaced apart to define a particular slot 114S therebetween to safely accommodate an irrigation line (not shown). Accordingly, if device 10 is forced into the ground, the risk of the device contacting and damaging an irrigation line can be advantageously reduced if not obviated. Notably, such a lower portion 113 can further include third and fourth stakes (not shown) providing another slot opposite the particular slot (not shown) that can similarly protect an irrigation line that passes under device 10.

Referring additionally to FIGS. 5A and 5B, upper portion 112 can include at least one removable layer 115*i* that defines an upward facing opening 116 exposing cavity 111. As further illustrated, removable layer 115*i* can optionally be provided as removable segments 119*i*, which collectively can form a removable layer. In an exemplary aspect, each removable layer 115*i* and/or associated segments 119*i* can be selectively broken off or otherwise removed to increase the overall size of opening 116, so as to accommodate a larger sized irrigation sprinkler, for example and not in limitation.

Figure 6A:
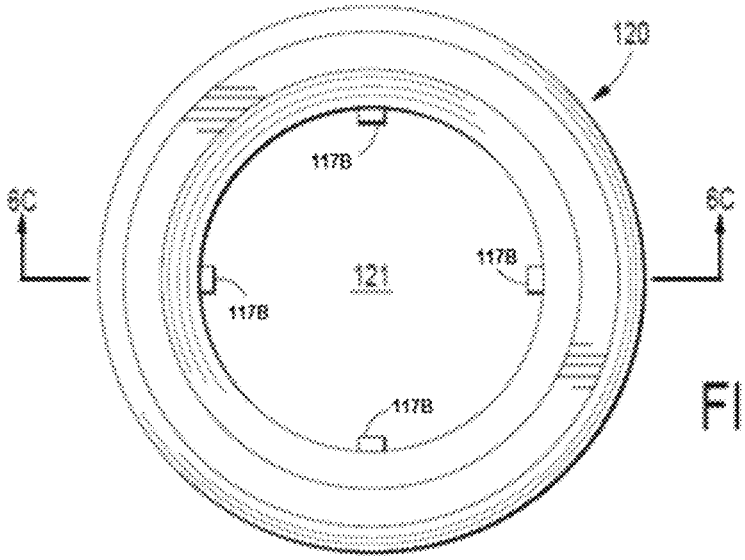
FIG. 6A is a top view of an exemplary top.
Figure 6B:
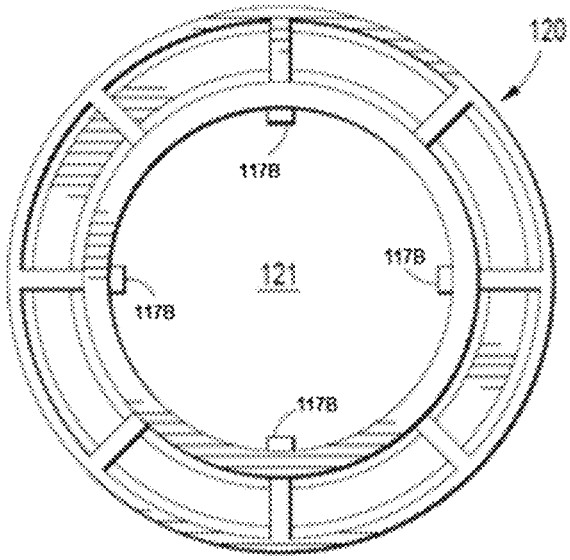
FIG. 6B is a bottom view of an exemplary top.
Figure 6C:
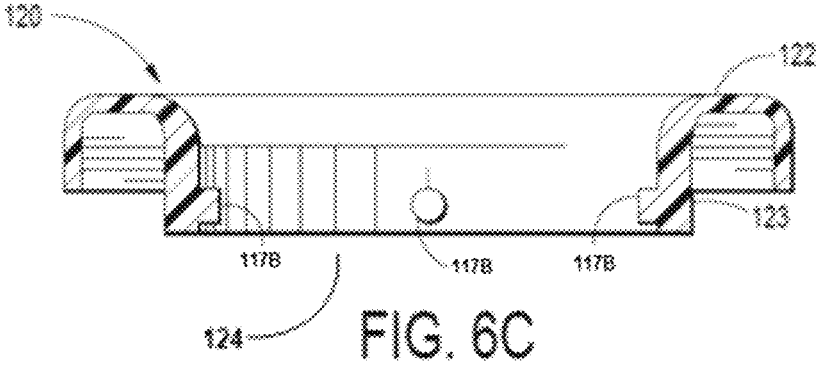
FIG. 6C is a section view of an exemplary top.

As illustrated in FIGS. 6A-6C, top 120 can include a channel 121 that can extend through upper and lower sections 122, 123 of the top. In an exemplary aspect, lower section 123 can include a downwardly facing opening 124 that exposes channel 121.

In still another exemplary aspect of the present invention, base 110 and top 120 can be configured to engage with each other. According to the present invention, base 110 and top 120 can engage in any known or apparent manner desired and utilize any one more engagement elements, such as a screw, bolt, snap, ferromagnetic element, or other structure, insofar as the same is functionally consistent with the present invention. As illustrated in FIGS. 3 and 4, base 110 can include at least one keyed structure 117*a*, whilst as illustrated in FIG. 6C, top 120 can include at least one nub 117*b*, with each being configured to complementarily engage the top with the base. Notably, keyed structure 117*a* and nub 117*b* can alternatively be provided with top 120 and base 110, respectively. With top 120 engaged with base 110, channel 121 can expose at least a portion of cavity 111, such that a sprinkler (not shown) can simultaneously pass through base 110 and top 120.

In yet another exemplary aspect, any one or more portions of the instant invention, such as stake 114, can be provided with a taper in at least one direction, which can facilitate manufacturing, strength, installation, and/or replacement of the instant invention. For example and not in limitation, as illustrated in FIGS. 3 and 4, base 110 can be tapered upwardly.

In still another exemplary aspect, as illustrated in FIG. 2, base 110 can optionally include an annular peripheral ledge 118 against which top 120 can abut whilst engaged with the base, for example and not in limitation.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore, I claim:

1. A sprinkler protection device, comprising:

a base having a cavity extending through upper and lower portions of said base, the lower portion having at least one downwardly extending stake, and the upper portion having at least one removable layer defining an upwardly facing opening exposing the cavity; and a top having an channel extending through upper and lower sections of said top, the lower section having a downwardly facing opening, exposing the channel, and being configured to removably engage with said base;

wherein one of the upper portion and the lower section includes a keyed structure, and the other of the upper portion and the lower section includes a nub compatibly shaped to the keyed structure so as to engage the keyed structure, and with said top engaged with said base, the channel exposes at least a portion of the cavity.

2. The device of claim 1, wherein each at least one removable layer decreases the size of the upwardly facing opening.

3. The device of claim 1, wherein said base is one of upwardly tapered and downwardly tapered.

4. The device of claim 1, the upper portion includes a plurality of removable layers, and each of the plurality of removable layers respectively reduces the size of the upwardly facing opening.

5. The device of claim 1, wherein the at least one stake is tapered.

6. The device of claim 1, wherein the upper portion includes an annular peripheral ledge that abuts said top.

7. The device of claim 1, wherein one of the at least one removable layer is provided as removable segments.

8. The device of claim 1, wherein the lower portion has first and second downwardly extending stakes spaced apart to define a particular slot therebetween.

9. The device of claim 8, wherein the lower portion includes third and fourth downwardly extending stakes spaced apart to define another slot therebetween and opposite the particular slot.

* * * * *